United States Patent [19]

Moore

[11] 4,176,343

[45] Nov. 27, 1979

[54] PORTABLE REMOTE CONTROL SIGNAL

[76] Inventor: Charles F. Moore, 3306 Beverly Rd., Baltimore, Md. 21214

[21] Appl. No.: 908,695

[22] Filed: May 23, 1978

Related U.S. Application Data

[63] Continuation-in-part of Ser. No. 792,778, May 2, 1977, abandoned.

[51] Int. Cl.[2] ..... G08B 3/00

[52] U.S. Cl. ..... 340/286 R; 340/310 A; 340/310 CP

[58] Field of Search ..... 340/286 R, 310 A, 310 CP

[56] References Cited

U.S. PATENT DOCUMENTS 2,077,328 4/1937 Kelly ..... 340/286 R

*Primary Examiner*—Harold I. Pitts

*Attorney, Agent, or Firm*—Walter G. Finch

[57] ABSTRACT

The invention is an improved remote control signal device that is portable. The remote control signal device is provided with an alarm, a remote control means connected to the alarm by electrical conductors, and a power source for the system. A novel connection is made in the power plug to permit the remote control means to activate the alarm at will.

8 Claims, 2 Drawing Figures

PORTABLE REMOTE CONTROL SIGNAL

The invention relates to alarm systems and in particular to an alarm system that is portable and specifically one which has a remote control. This application is a continuation-in-part of U.S. patent application Ser. No. 792,778 filed by the Applicant on May 2, 1977 for a "Portable Remote Control Signal", now abandoned.

BACKGROUND AND SUMMARY OF THE INVENTION

The portable alarm system, with a remote control, is particularly useful for making it convenient to place patients, invalids, infirm persons, elderly people and others in various locations about the house or the grounds around a residence, and provide them with a means of easily summoning assistance when needed.

The system can also be used in multiple care institutions where more than one individual is involved, it being only necessary to mark or otherwise identify the particular alarm with a specific individual.

The alarm may be audible (such as a bell or buzzer) or silent (such as a light). The entire system may be portable, as will be shown hereinafter, or parts of it may be made portable, such as the alarm portion and the remote control portion, with the balance between the two stations being of a permanent or semi-permanent nature.

It is therefore an object of the invention to provide a portable remote control signal that has a portable alarm, a portable remote control, and a portable connection therebetween.

It is another object of the invention to provide a portable remote control signal that has a portable alarm, a portable remote control, and a permanently installed connection therebetween.

It is still another object of the invention to provide a portable remote control signal that has a portable alarm, a portable remote control, and a semi-permanently installed connection therebetween.

It is yet another object of the invention to provide a portable remote control signal that has a portable alarm, a portable remote control, and a plurality of connection stations along a connection means between said alarm and said remote control.

It is also an object of the invention to provide a portable remote control signal that has a novel connection for the remote control within the power plug for the system.

Further objects and advantages of the invention will become more apparent in light of the following description of the preferred embodiments.

DESCRIPTION OF THE PREFERRED EMBODIMENTS

Figure 1:
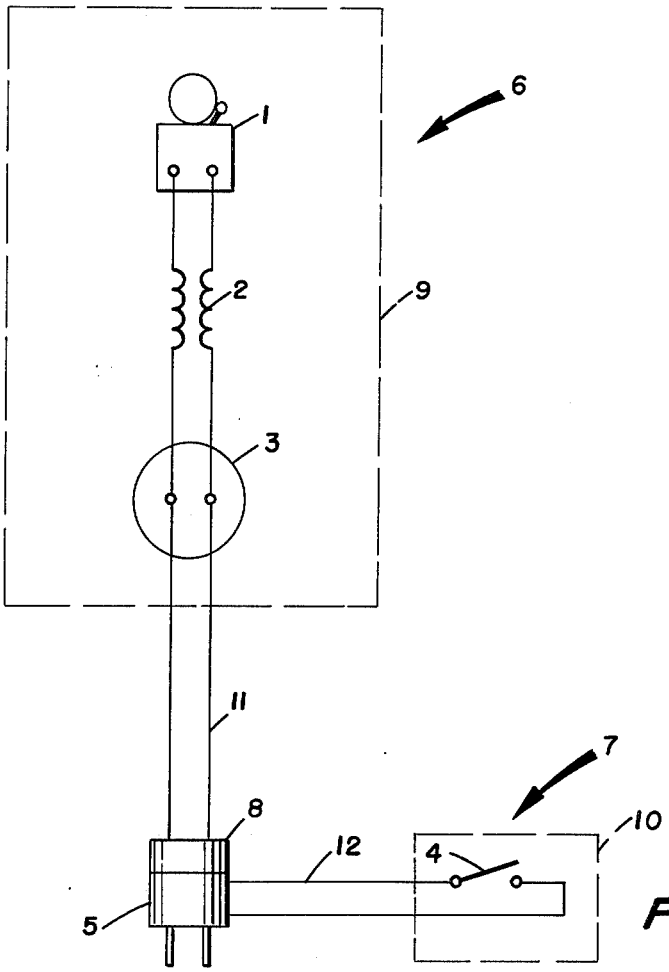
FIG. 1 is a schematic wiring diagram of the system.

Referring now to the drawings, and particularly to FIG. 1, the portable alarm portion of the system is shown at 6 and the portable remote control is shown at 7.

Figure 2:
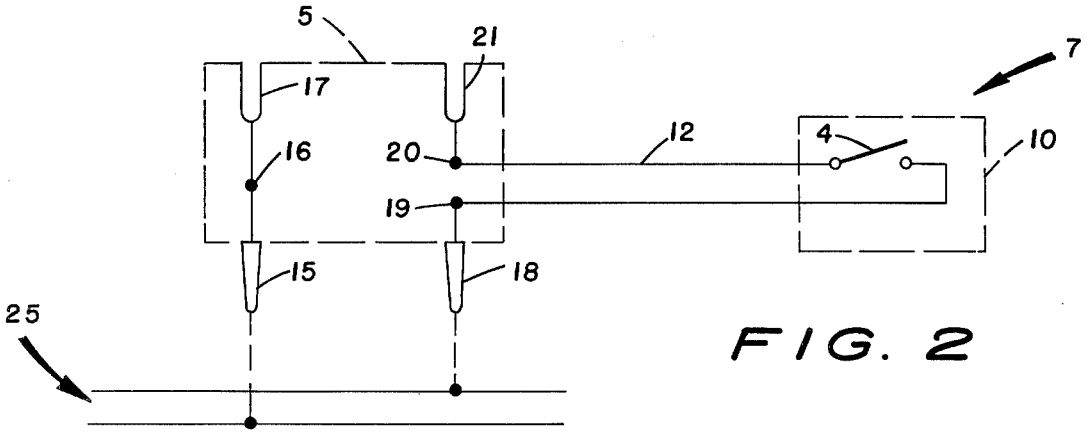
FIG. 2 is a schematic wiring diagram of the remote control and the connection within the power plug.

The connection of the remote control 7 to the alarm 6 is made at and within the power plug 5 in FIG. 1. The details of the connection of the remote control 7 to the alarm 6 in power plug 5 is shown in FIG. 2. The details of the connection of the portable alarm portion 6 and the portable remote control 7 to the power plug 5 are described hereinafter.

The portable alarm portion 6 is shown mounted on a base 9 and is easily portable. The base 9 may be of any material to which the elements, described hereinafter, may be affixed by suitable means. The base 9 may be wood, plastics, metal, or other suitable material.

The elements of the portable alarm portion 6 affixed to base 9 are the alarm 1, a transformer 2, and a junction box 3.

The alarm 1 may be audible, such as a bell or a buzzer or similar audible noise maker, or a visual light, such as an electric incandescent lamp, a neon light, or any other electrically activated light means.

The terminals of alarm 1 is connected to the terminals of the low voltage side of transformer 2. It is to be noted that the use of an alarm that is capable of activation by full line current and voltage that eliminates the need for a transformer is within the scope and intent of this invention.

The terminals of the high voltage side of transformer 2 are connected to a junction box 3.

The portable alarm portion 6 has a pair of conductors 11 and a plug 8 connected to said portable alarm portion 6 for connection to the power plug 8. The pair of conductors 11 are connected at one end to the junction box 3 and at the other end to the plug 8. The pair of conductors 11 may be loose individual conductors or may be combined in a sheathed cord, the latter being the preferred embodiment.

It is to be noted that direct connection of the pair of conductors 11 to the high voltage terminals of the transformer 2 or through a connecting means other than a junction box 3 is within the scope and intent of this invention.

The length of the conductors 11 may be varied to suit the needs. For example, the location of the portable remote control 7 with the user may be in the next room and require a relatively short length of conductors 11, or it may be on another floor or outside requiring a rather long length of conductors 11.

In the case of very long lengths of conductors 11, a portion of the run may be separately and permanently installed on or within walls or ceilings, with a suitable connecting receptacle at one end into which plug 8 on a relatively short run of conductors 11 (attached to the portable alarm 6) may be plugged. At the other end of the long run of the separately and permanently installed conductors 11 a plug 8 would be the connecting point to the power plug 5.

Instead of permanently installing the separate portion of the conductors 11 as hereinbefore described, it may be desirable to make the installation semi-permanent by merely attaching the separate run of conductors 11 to the base boards, casings, and other trim by clips or other temporary fastening means.

The use of permanent or semi-permanent installations of portions of the run of conductors 11 is within the scope and intent of this invention though not represented on the drawings.

A plurality of stations (not shown in the drawings) may be installed along the permanent or semi-permanent installation of a portion of the run of conductors 11 so as to provide flexibility for locating the portable alarm 6 or the portable remote control 7, depending on the needs of the user and the attendant. Such a plurality of stations for flexibility is within the scope and intent of this invention. Each such station, in the form of an electrical plug, being equipped with a blank cap receptacle for safety purposes when not in use.

The portable remote control 7 is shown mounted on a base 10 and is easily portable. The base 10 may be any material to which the switch 4 may be affixed by suitable means. The base 10 may be wood, plastics, metal or other suitable material.

The switch 4 may be a rotary, push-button, toggle, or any other type switch which is best suited for the user. The terminals of switch 4 are connected to the power plug 5 by a pair of conductors 12. The length of conductors 12 must be such so as to reach from the location of the user to the nearest power-source receptacle. The pair of conductors 12 may be loose individual conductors or may be combined in a sheathed cord, the latter being the preferred embodiment.

The power plug 5 has prongs of a male plug on one side for plugging into a power-source receptacle, and on the opposite side has the sheath openings of a female receptacle into which plug 8 at the end of the conductors 11 is inserted.

The wiring connections within the power plug 5 are shown in FIG. 2. The prongs 15 and 18 of power plug 5 are separately connected to the sheath receptacles 17 and 21, but by a different and novel method than is found in an ordinary combination plug receptacle.

In an ordinary combination plug-receptacle, each prong of the plug is separately connected to the sheath receptacles (usually a plurality of pairs of sheath receptacles) which it serves. Thus one-half of each set of sheath receptacles are connected directly to one prong and the other matching one-half of each set of sheath receptacles is connected directly to the other prong, so that each set of sheath receptacles is "live" when the pair of prongs on the combination plug-receptacle is plugged into a receptacle on a power-source line.

In the present invention, prong 15 is connected 16 directly to sheath receptacle 17. Prong 18 is connected 19 to one of the pair of conductors 12 within the power plug 5. The other conductor of the pair of conductors 12 is connected 20 to sheath receptacle 21 within the power plug 5. Thus, switch 4 on base 10 (remote control 7) interrupts the circuit between the prong 18 and the sheath receptacle 21.

When power plug 5 is plugged into a power-source receptacle of power source 25 (by prongs 15 and 18) and the prongs of plug 8 are plugged into the power plug 5 by inserting the prongs of plug 8 into the sheath receptacles 17 and 21, the complete circuit is established, but is interrupted by switch 4. When switch 4 is closed the alarm 1 will be activated.

It is to be understood that substitution of a power source other than the power system of ordinary house current (such as a battery or other electrical supply means) is within the scope and intent of this invention.

As can be readily understood from the foregoing description of the invention, the present structure can be configured in different modes to provide the ability to have a portable alarm system with a remote control.

Accordingly, modifications and variations to which the invention is susceptible may be practiced without departing from the scope and intent of the appended claims.

What is claimed is:

1. A portable remote control signaling device, comprising, an alarm means;

a remote control means;

an electrical conductor system electrically connected to said alarm means and to said remote control means for activating said alarm means;

said electrical conductor system consisting of:

a first length of two-wire electrical conductor;

an electrical junction box connected to one end of said two-wire electrical conductor;

a first portable base for said junction box and said alarm means;

an electrical transformer affixed to said portable base, with the low voltage side of said transformer being connected to said alarm means, and the high voltage side of said transformer being connected to said junction box;

an electrical plug affixed to the second end of said two-wire electrical conductor;

a second length of two-wire electrical conductor, the first end of which is connected to said remote control means, a second portable base having said remote control means affixed thereto; and an electrical power source having a plug with a pair of prong-like connecting means on one side thereof, and a pair of sheath-like receptacle connecting means on the opposite side thereof, said prong-like connecting means being electrically connected to said power source, said electrical plug being connected to said second end of first two-wire electrical conductor and being inserted in said sheath-like receptacle connecting means, the first prong of said power source plug being directly connected to a first sheath of said sheath-like receptacles, the second prong of said power source plug being connected within said power-source plug to a first wire of said second two-wire conductor and second wire of said second two-wire conductor being connected to the second sheath of said sheath-like receptables.

2. The portable remote control signaling device recited in claim 1, wherein said alarm means is an audible sound device.

3. The portable remote control signaling device recited in claim 1, wherein said alarm means is a visual light device.

4. The portable remote control signaling device recited in claim 1, wherein said remote control means is a rotary switch.

5. The portable remote control signaling device recited in claim 1, wherein said alarm means and said remote control means are affixed to separate portable bases.

6. The portable remote control signaling device recited in claim 1, wherein said first length of two-wire electrical conductor has a plurality of electrical plugs spaced along its length in addition to said electrical plug affixed to said second end thereof, each said electrical plug and said electrical plug affixed to second end thereof being supplied with a blank cap receptacle for safety purposes when not in use.

7. The portable remote control signaling device recited in claim 1 wherein the portability of the device is in two parts, the first part consisting of the first length of two-wire electrical conductor and all structures connected directly thereto and to said portable base to which said alarm means is affixed, and the second part consisting of said second length of two-wire electrical conductor and all structures connected directly thereto and to said portable base to which said remote control means is affixed.

8. The portable remote control signaling device recited in claim 7 wherein said first length of two-wire electrical conductor is relatively short and additionally a permanently installed two-wire conductor extending from the location area of said base with alarm means affixed thereto to the location area of said base with remote control means affixed thereto, said permanently installed two-wire conductor having an electrical receptacle affixed to the end thereof in the location area of said base with alarm means affixed thereto, and an electrical plug affixed to the end thereof in the location area of said base with remote control means affixed thereto.

* * * * *